US012624520B2

(12) United States Patent
Sakisaka et al.

(10) Patent No.: US 12,624,520 B2
(45) Date of Patent: May 12, 2026

(54) CONSTRUCTION MACHINE

(71) Applicant: Hitachi Construction Machinery Tierra Co., Ltd., Koka (JP)

(72) Inventors: Keisuke Sakisaka, Koka (JP); Masayuki Yunoue, Koka (JP); Masaya Harada, Koka (JP); Takuya Nomura, Rittou (JP)

(73) Assignee: HITACHI CONSTRUCTION MACHINERY TIERRA CO., LTD., Koka (JP)

( * ) Notice: Subject to any disclaimer, the term of this patent is extended or adjusted under 35 U.S.C. 154(b) by 400 days.

(21) Appl. No.: 18/039,585

(22) PCT Filed: Jan. 18, 2022

(86) PCT No.: PCT/JP2022/001670
§ 371 (c)(1),
(2) Date: May 31, 2023

(87) PCT Pub. No.: WO2022/190650
PCT Pub. Date: Sep. 15, 2022

(65) Prior Publication Data

US 2024/0093463 A1 Mar. 21, 2024

(30) Foreign Application Priority Data

Mar. 11, 2021 (JP) ..... 2021-039743

(51) Int. Cl.
*E02F 3/84* (2006.01)
*E02F 3/96* (2006.01)
(Continued)

(52) U.S. Cl.
CPC ..... *E02F 3/844* (2013.01); *E02F 9/2004* (2013.01); *E02F 9/24* (2013.01); *E02F 3/964* (2013.01); *E02F 9/2203* (2013.01)

(58) Field of Classification Search
CPC ..... E02F 3/84; E02F 3/844845; E02F 3/847; E02F 9/24; E02F 9/2004; E02F 9/2203; E02F 3/964
See application file for complete search history.

(56) References Cited

U.S. PATENT DOCUMENTS 6,098,322 A 8/2000 Tozawa et al.
6,286,606 B1 9/2001 Krieg et al.
(Continued)

FOREIGN PATENT DOCUMENTS

JP 07-003836 A 1/1995
JP 10-259618 A 9/1998
(Continued)

OTHER PUBLICATIONS

International Preliminary Report on Patentability received in corresponding International Application No. PCT/JP2022/001670 dated Sep. 21, 2023.
(Continued)

*Primary Examiner* — Tara Mayo
(74) *Attorney, Agent, or Firm* — MATTINGLY & MALUR, PC

(57) ABSTRACT

A construction machine is capable of returning the posture of an earth removal plate (blade) from a rocking posture to a predetermined normal posture. A stay is mounted on the construction machine body to move in upward and downward directions. The earth removal plate is mounted on the distal end portion of the stay, and is rockably movable in forward and rearward directions by an angle cylinder controlled by a flow of hydraulic fluid in response to receiving an instruction about rocking the earth removal plate. A normalization switch gives an instruction to set the posture of the earth removal plate to a predetermined normal posture from the rocking posture. The posture of the earth removal plate is set to the predetermined normal posture from the
(Continued)

rocking posture in response to the instruction from the normalization switch.

2 Claims, 4 Drawing Sheets

(51) Int. Cl.

| | |
|---|---|
| ***E02F 9/20*** | (2006.01) |
| ***E02F 9/22*** | (2006.01) |
| ***E02F 9/24*** | (2006.01) |

(56) References Cited

U.S. PATENT DOCUMENTS

| | | | |
|---|---|---|---|
| 2009/0044434 | A1 | 2/2009 | Breuer et al. |
| 2014/0345889 | A1 | 11/2014 | Nakata et al. |
| 2022/0049473 | A1 | 2/2022 | Takaoka |

FOREIGN PATENT DOCUMENTS

| | | | |
|---|---|---|---|
| JP | 11-280118 | A | 10/1999 |
| JP | 2010-126932 | A | 6/2010 |
| JP | 2011-014104 | A | 1/2011 |
| JP | 2012-072636 | A | 4/2012 |
| JP | 2013-181274 | A | 9/2013 |
| JP | 2014-031696 | A | 2/2014 |
| JP | 2019-167686 | A | 10/2019 |
| JP | 2020-084460 | A | 6/2020 |

OTHER PUBLICATIONS

Extended European Search Report received in corresponding European Application No. 22766618.7 dated Oct. 9, 2024.

International Search Report of PCT/JP2022/001670 dated Apr. 12, 2022.

CONSTRUCTION MACHINE

TECHNICAL FIELD

The present invention relates to a construction machine including an earth removal apparatus.

BACKGROUND ART

Hydraulic excavators that belong to a category of construction machines generally include a lower track structure that is able to travel on its own and an upper swing structure swingably mounted on an upper side of the lower track structure. The lower track structure and the upper swing structure jointly make up a machine body. The upper swing structure includes a work implement for performing an earth excavation work or the like. The lower track structure includes an earth removal apparatus for performing an earth removal work or the like.

For example, Patent Document 1 discloses an earth removal apparatus that includes a stay disposed, on a front side of a lower track structure, turnably in upward and downward directions, an earth removal plate (blade) mounted, on a distal end portion of the stay, rockably in forward and rearward directions about a pin shaft (joint pin) extending in upward and downward directions, a lifting and lowering cylinder (blade cylinder) for turning the stay in the upward and downward directions to lift and lower the earth removal plate, and an angle cylinder for rocking the earth removal plate in the forward and rearward directions.

While the stay is turned downwardly to keep the earth removal plate in contact with the ground, the hydraulic excavator is driven to travel, enabling the earth removal plate to push soil on the ground for leveling the land. At this time, if the posture of the earth removal plate is set to a predetermined normal posture (stated in detail, a posture in which the earth removal plate has its longitudinal directions oriented perpendicularly to the direction in which the hydraulic excavator moves straight ahead), then it is possible for the earth removal plate to level the land by discharging soil to both left and right sides thereof. If the earth removal plate is rocked to one side to have such a rocking posture that the earth removal plate has a left end portion positioned rearwardly and has a right end portion positioned forwardly, then it is possible for the earth removal plate to level the land while discharging soil to the left side thereof. Alternatively, if the earth removal plate is rocked to the other side to have such a rocking posture that the earth removal plate has the left end portion positioned forwardly and the right end portion positioned rearwardly, then it is possible for the earth removal plate to level the land while discharging soil to the right side thereof.

PRIOR ART DOCUMENT

Patent Document

Patent Document 1: JP-2013-181274-A

SUMMARY OF THE INVENTION

Problem to be Solved by the Invention

However, the prior art described above has room left for improvement as follows. According to the prior art, when the posture of the earth removal plate is to be returned from the rocking posture to the predetermined normal posture depending on the progress of the land leveling work, it has been customary for the operator to adjust the posture of the earth removal plate by operating an operation unit while confirming the posture of the earth removal plate. Therefore, it has not been easy to return the posture of the earth removal plate from the rocking posture to the predetermined normal posture.

It is an object of the present invention to provide a construction machine that makes it possible to easily return the posture of an earth removal plate from a rocking posture to a predetermined normal posture.

Means for Solving the Problem

In order to achieve the above object, there is provided in accordance with the present invention, there is provided a construction machine including a stay mounted, on a machine body, turnably in upward and downward directions, an earth removal plate mounted, on a distal end portion of the stay, rockably in forward and rearward directions, an angle cylinder for rocking the earth removal plate in forward and rearward directions, a control valve for controlling a flow of hydraulic fluid flowing from a hydraulic pump to the angle cylinder, an operation unit for giving an instruction about rocking action of the earth removal plate in forward and rearward directions, and a controller for controlling the control valve in response to the instruction from the operation unit, in which the construction machine includes a normalization switch for giving an instruction to the controller to set a posture of the earth removal plate to a predetermined normal posture from a rocking posture for rocking the earth removal plate in forward and rearward directions, and the controller controls the control valve to set the posture of the earth removal plate to the predetermined normal posture from a rocking posture for rocking the earth removal plate in forward and rearward directions, in response to the instruction from the normalization switch.

Advantage of the Invention

According to the present invention, it is easy to return the posture of an earth removal plate from a rocking posture to a predetermined normal posture.

MODE FOR CARRYING OUT THE INVENTION

An embodiment of the present invention will be described hereinbelow with reference to the drawings.

Figure 1:
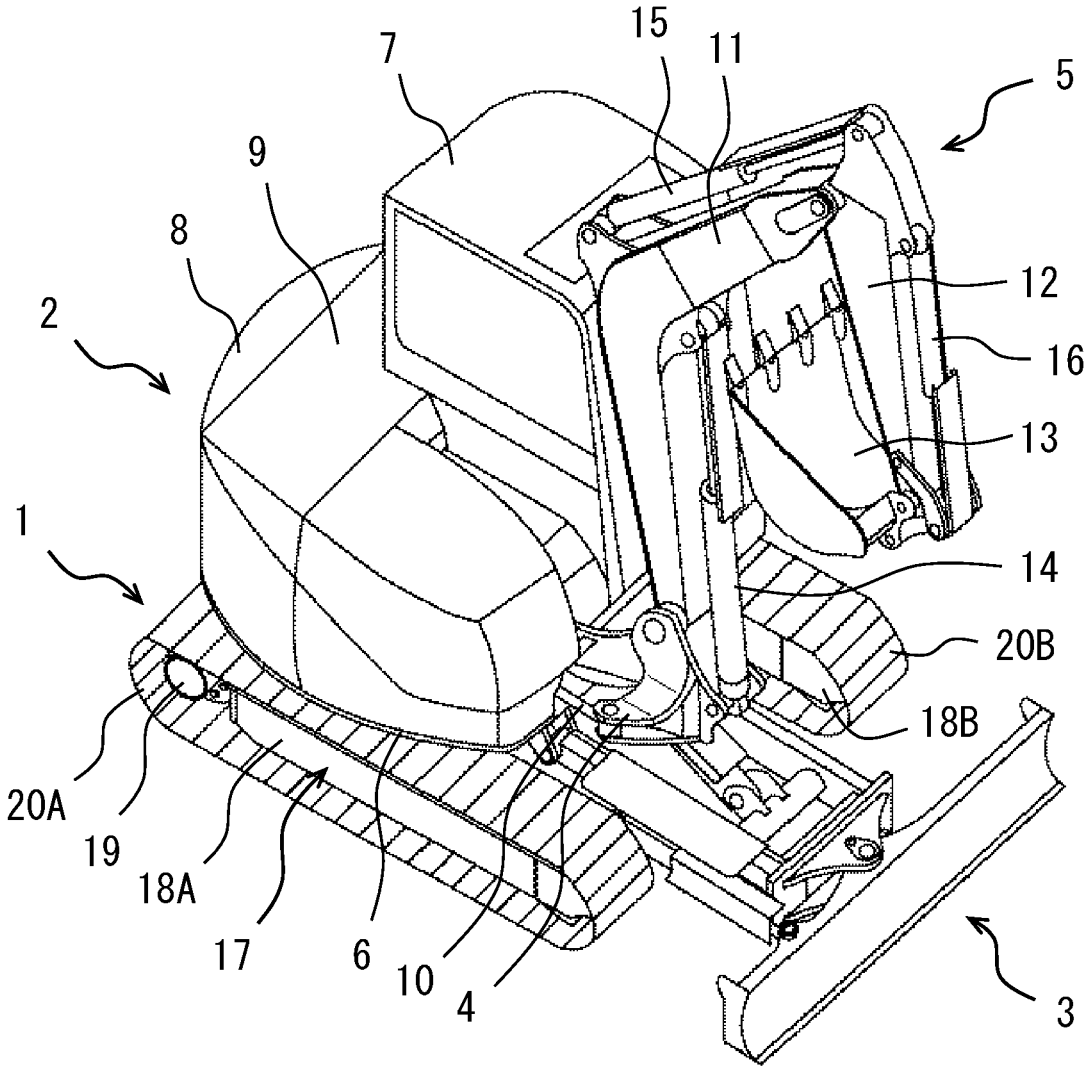
FIG. 1 is a perspective view illustrating the structure of a hydraulic excavator according to an embodiment of the present invention.
Figure 2:
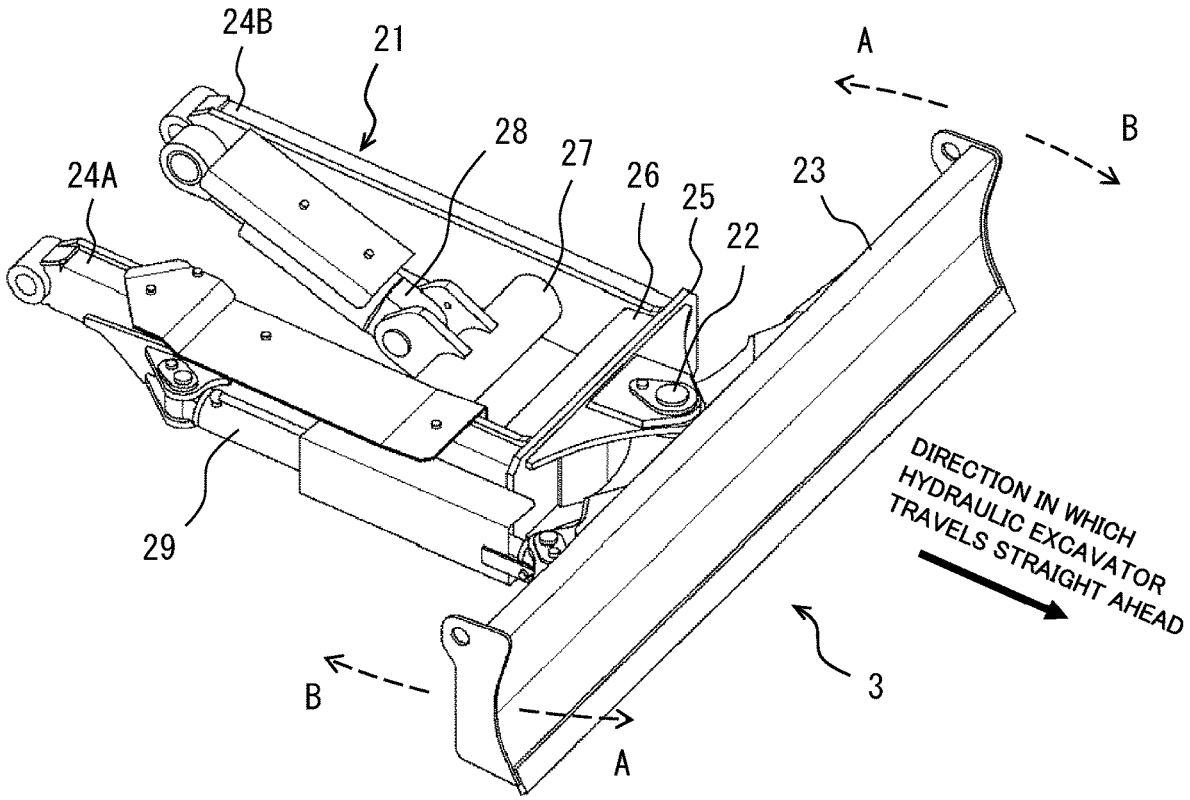
FIG. 2 is a perspective view illustrating the structure of an earth removal apparatus according to the embodiment of the present invention, with an earth removal plate being in a predetermined normal posture.

FIG. 1 is a perspective view illustrating the structure of a hydraulic excavator according to the present embodiment. FIG. 2 is a perspective view illustrating the structure of an earth removal apparatus according to the embodiment of the present invention, with an earth removal plate being in a predetermined normal posture (stated in detail, a posture in which an earth removal plate has its longitudinal directions oriented perpendicularly to the direction in which the hydraulic excavator moves straight ahead). It is assumed that when the operator is seated on the operator's seat of the hydraulic excavator that is in a state illustrated in FIG. 1, the front side (right side in FIG. 1), the rear side (left side in FIG. 1), the right side (lower side in FIG. 1), and the left side (upper side in FIG. 1) of the operator will simply be referred to as front side, rear side, right side, and left side, respectively.

The hydraulic excavator according to the present embodiment includes a lower track structure 1 that is able to travel on its own and an upper swing structure 2 swingably mounted on an upper side of the lower track structure 1. The lower track structure 1 and the upper swing structure 2 jointly make up a machine body. Further, the hydraulic excavator includes an earth removal apparatus 3 mounted on a front side of the lower track structure 1 and a work implement 5 coupled to a front side of the upper swing structure 2 via a swing post 4.

The upper swing structure 2 includes a swing frame 6 as a basic structural body, a cabin 7 mounted on a front portion of the swing frame 6 and to be occupied by the operator, a counterweight 8 attached to a rear end of the swing frame 6, and a machine room 9 mounted on a rear portion of the swing frame 6 (stated in detail, between the cabin 7 and the counterweight 8). The cabin 7 houses therein a plurality of operation units that are used by the operator to give instructions about traveling action of the lower track structure 1, swinging action of the upper swing structure 2, action of the earth removal apparatus 3, action of the swing post 4, and action of the work implement 5. The machine room 9 houses therein an engine, a hydraulic pump, etc.

The swing post 4 is coupled to a front side of the swing frame 6 turnably in leftward and rightward directions. When a swing cylinder 10 is driven to extend and contract, the swing post 4 is thereby turned in leftward and rightward directions, and the work implement 5 is turned in leftward and rightward directions.

The work implement 5 includes a boom 11 coupled to the swing post 4 turnably in upward and downward directions, an arm 12 coupled to the boom 11 turnably in upward and downward directions, and a bucket 13 coupled to the arm 12 turnably in upward and downward directions. When a boom cylinder 14, an arm cylinder 15, and a bucket cylinder 16 are driven to extend and contract, the boom 11, the arm 12, and the bucket 13 are thereby turned.

The lower track structure 1 includes a track frame 17. The track frame 17 includes a center frame (not shown), a right side frame 18*a* disposed on the right side of the center frame, and a left side frame 18B disposed on the left side of the center frame.

A drive wheel 19 and a travel motor (not shown) for rotating the drive wheel 19 are mounted on a rear end side of the right side frame 18A. A driven wheel (not shown) is rotatably mounted on a front end side of the right side frame 18A. A crawler belt (crawler) 20A is trained around the drive wheel and the driven wheel. When the travel motor on the right side is driven, the drive wheel 19 on the right side is rotated to thereby rotate the crawler belt 20A on the right side.

Similarly, a drive wheel (not shown) and a travel motor (not shown) for rotating the drive wheel are mounted on a rear end side of the left side frame 18B. A driven wheel (not shown) is rotatably mounted on a front end side of the left side frame 18B. A crawler belt (crawler) 20B is trained around the drive wheel and the driven wheel. When the travel motor on the left side is driven, the drive wheel on the left side is rotated to thereby rotate the crawler belt 20B on the left side.

A swing wheel (not shown) is mounted on the center frame, and the upper swing structure 2 is swingably mounted via the swing wheel. When a swing motor (not shown) is driven, the upper swing structure 2 is swung.

The earth removal apparatus 3 includes a stay 21 mounted, on a front side of the center frame of the track frame 17, turnably in upward and downward directions, and an earth removal plate (blade) 23 mounted, on a distal end portion of the stay 21, rockably in forward and rearward directions about a pin shaft 22 that extends in upward and downward directions.

The stay 21 includes a pair of support arms 24A and 24B, an earth removal plate support member 25, a reinforcement beam 26, and a cylinder mount beam 27. The support arms 24A and 24B extend in forward and rearward directions and are spaced apart from each other in leftward and rightward directions. The support arms 24A and 24B are coupled to the front side of the center frame of the track frame 17 turnably in upward and downward directions.

The earth removal plate support member 25 is mounted on distal end sides of the support arms 24A and 24B and has a bracket structure that includes a vertical plate and a pair of horizontal plates mounted on the vertical plate while being spaced from each other in upward and downward directions. The earth removal plate 23 is rockably supported on the earth removal plate support member 25 via the pin shaft 22.

The reinforcement beam 26 is joined to the support arms 24A and 24B and the earth removal plate support member 25. The cylinder bound beam 27 is positioned behind the reinforcement beam 26 and joined to the support arms 24A and 24B. A lifting and lowering cylinder 28 is disposed between the cylinder mount beam 27 and the track frame 17. When the lifting and lowering cylinder 28 is driven to extend and contract, the stay 21 is turned in upward and downward directions, thereby lifting and lowering the earth removal plate 23.

An angle cylinder 29 is disposed between the support arm 24A on the right side and the earth removal plate 23. When the angle cylinder 29 is driven to expend and contract, the earth removal plate 23 is rocked in forward and rearward directions about the pin shaft 22.

Figure 3:
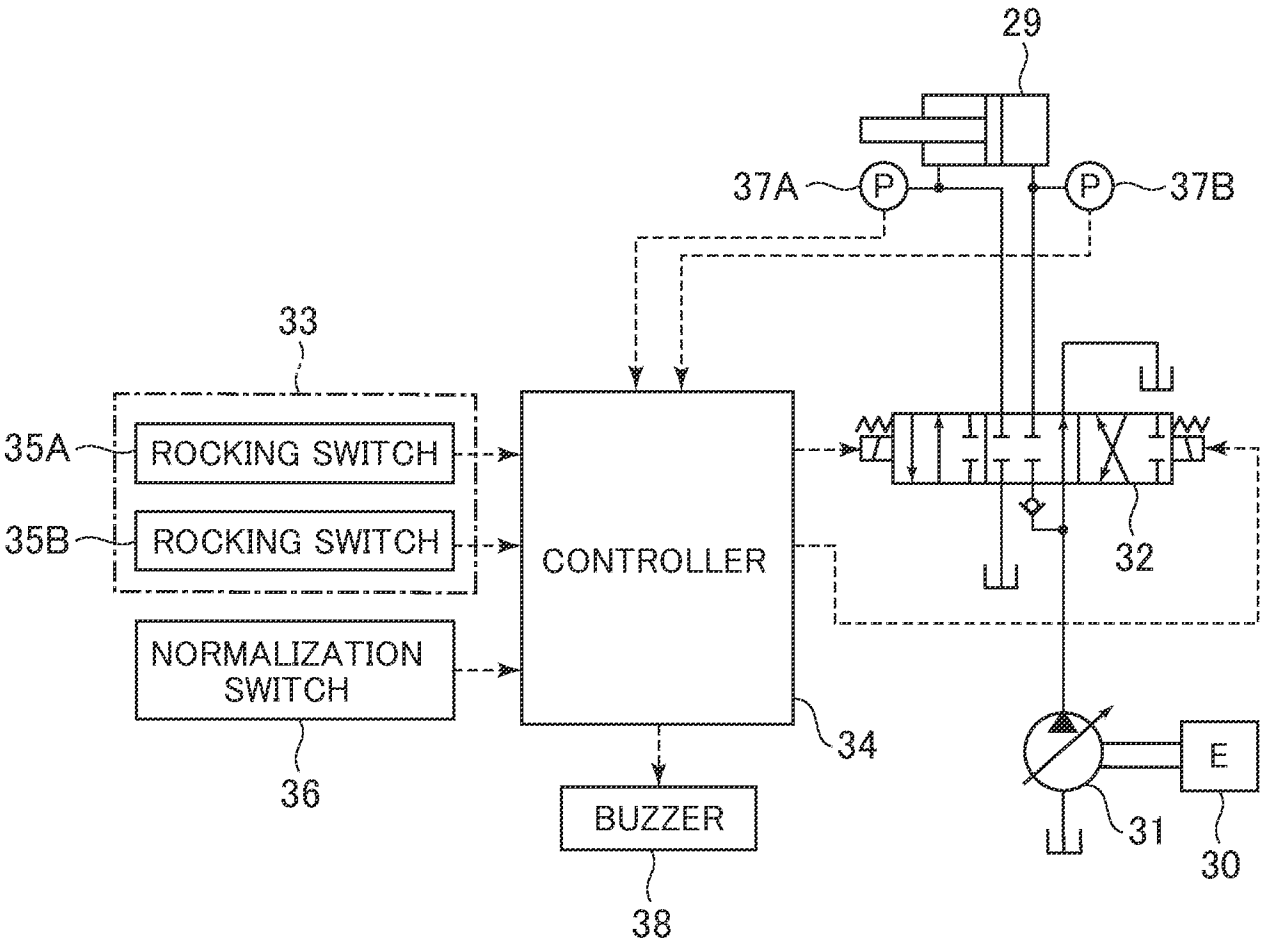
FIG. 3 is a block diagram illustrating the arrangement of a drive system for driving an angle cylinder according to the embodiment of the present invention.

A drive system for rocking the earth removal plate 23 described above, i.e., for driving the angle cylinder 29, will be described below. FIG. 3 is a diagram illustrating the arrangement of the drive system for driving the angle cylinder according to the present embodiment.

The drive system according to the present embodiment includes a hydraulic pump 31 driven by an engine 30 (prime mover), a control valve 32 for controlling a flow of hydraulic fluid flowing from the hydraulic pump 31 to the angle cylinder 29, an operation unit 33 used by the operator to give instructions about rocking action of the earth removal plate 23 in forward and rearward directions, and a controller 34 for controlling the control valve 32 according to instructions from the operation unit 33. The operation unit 33 includes an operation switch 35A for giving an instruction about rocking one side of the earth removal plate 23 and an operation switch 35B for giving an instruction about rocking the other side of the earth removal plate 23. Each of the operation switches 35A and 35B is of the pushbutton type, for example.

The controller 34, when receiving an instruction signal from the operation switch 35A, outputs a drive signal (extension signal) to the solenoid on the left side, as illustrated, of the control valve 32. The controller 34 thereby switches the control valve 32 to a switched position on the left side, as illustrated, to cause hydraulic fluid flowing from the hydraulic pump 31 to be supplied to the bottom side of the angle cylinder 29. As a result, the angle cylinder 29 is extended to rock the earth removal plate 23 in the direction indicated by the arrow A in FIG. 2.

The controller 34, when receiving an instruction signal from the operation switch 35B, outputs a drive signal (contraction signal) to the solenoid on the right side, as illustrated, of the control valve 32. The controller 34 thereby switches the control valve 32 to a switched position on the right side, as illustrated, to cause hydraulic fluid from the hydraulic pump 31 to be supplied to the rod side of the angle cylinder 29. As a result, the angle cylinder 29 is contracted to rock the earth removal plate 23 in the direction indicated by the arrow B in FIG. 2.

According to a feature of the present embodiment, the drive system includes a normalization switch 36 for instructing the controller 34 to set the posture of the earth removal plate 23 to a predetermined normal posture (stated in detail, a posture in which the earth removal plate 23 has its longitudinal directions oriented perpendicularly to the direction in which the hydraulic excavator moves straight ahead) from a rocking posture for rocking the earth removal plate 23 in forward and rearward directions. The controller 34, in response to the instruction from the normalization switch 36, controls the control valve 32 to set the posture of the earth removal plate 23 to the predetermined normal posture (normalization of the posture of the earth removal plate 23) from a rocking posture for rocking the earth removal plate 23 in forward and rearward directions.

According to another feature of the present embodiment, moreover, the drive system includes pressure sensors 37A and 37B for sensing a load pressure on the angle cylinder 29. The controller 34, when controlling the control valve 32 in response to the instruction from the normalization switch 36, stops controlling the control valve 32 if the load pressure sensed by the pressure sensor 37A or 37B is higher than a predetermined threshold value.

Note that the controller 34 computes the stroke of the angle cylinder 29 and stores the computed stroke on the basis of the instruction signals from the operation switches 35A and 35B. Furthermore, the controller 34 also stores a normal stroke of the angle cylinder 29 that has been preset according to the predetermined normal posture of the earth removal plate 23. The normalization switch 36 is of the pushbutton type, for example.

Figure 4:
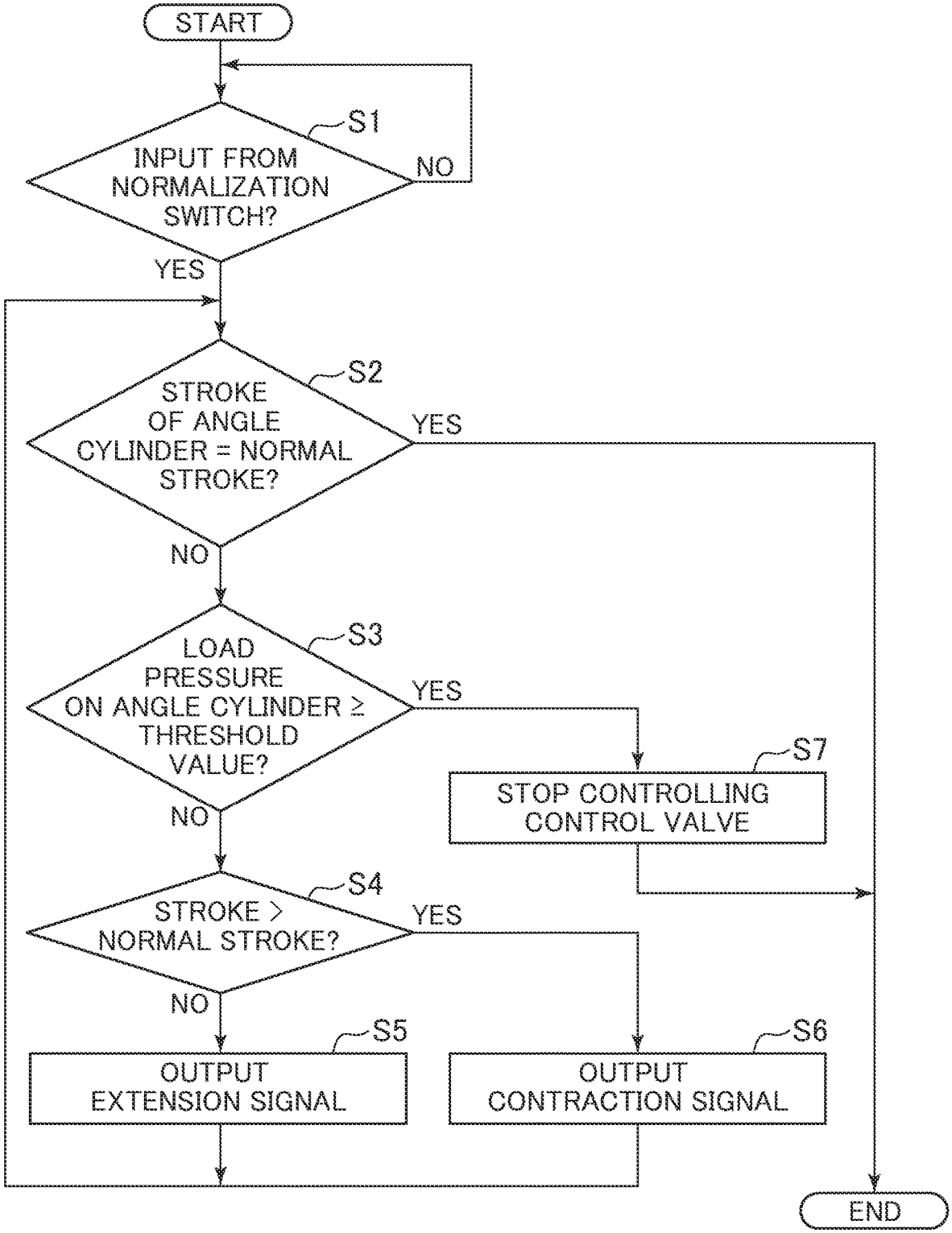
FIG. 4 is a flowchart of the processing sequence of a controller for normalizing the posture of the earth removal plate according to the embodiment of the present invention.

A processing sequence of the controller 34 for normalizing the posture of the earth removal plate 23 will be described below. FIG. 4 is a flowchart of the processing sequence of the controller for normalizing the posture of the earth removal plate according to the present embodiment.

In step S1, the controller 34 determines whether an instruction signal has been input from the normalization switch 36 or not. When an instruction signal has not been input from the normalization switch 36, the determining process in step S1 is repeated. On the other hand, when an instruction signal has been input from the normalization switch 36, the processing goes to step S2.

In step S2, the controller 34 determines whether the stroke of the angle cylinder 29 is the preset normal stroke or not, thereby determining whether the earth removal plate 23 is of the predetermined normal posture or not. When the stroke of the angle cylinder 29 is not the preset normal stroke, the processing goes to step S3.

In step S3, the controller 34 selects the pressure sensor 37A that is associated with the rod side of the angle cylinder 29 when the stroke of the angle cylinder 29 is smaller than the preset normal stroke, selects the pressure sensor 37B that is associated with the bottom side of the angle cylinder 29 when the stroke of the angle cylinder 29 is larger than the preset normal stroke, and determines whether or not the load pressure on the angle cylinder 29 sensed by the selected pressure sensor is equal to or higher than the predetermined threshold value, thereby determining whether the angle cylinder 29 is overloaded or not. When the load pressure on the angle cylinder 29 is smaller than the predetermined threshold value, the processing goes to step S4.

In step S4, the controller 34 determines whether the stroke of the angle cylinder 29 is larger than the preset normal stroke or not. When the stroke of the angle cylinder 29 is smaller than the preset normal stroke, the processing goes to step S5. In step S5, the controller 34 outputs the extension signal referred to above to switch the control valve 32, extending the angle cylinder 29. On the other hand, when the stroke of the angle cylinder 29 is larger than the preset normal stroke, the processing goes to step S6. In step S6, the controller 34 outputs the contraction signal referred to above to switch the control valve 32, contracting the angle cylinder 29.

After step S5 or S6, the processing returns to step S2. In step S2, when the stroke of the angle cylinder 29 is the preset normal stroke, i.e., when the earth removal plate 23 is in the predetermined normal posture, the posture-normalizing processing sequence is ended. On the other hand when the stroke of the angle cylinder 29 is not the preset normal stroke, the processing goes to step S3, repeating the processing sequence described above.

When the load pressure on the angle cylinder 29 is equal to or higher than the predetermined threshold value, i.e., when the angle cylinder 29 is overloaded, the processing goes to step S7. In step S7, the controller 34 stops controlling the control valve 32 and energizes a buzzer 38 to produce a buzzing sound, for example.

According to the present embodiment, as described above, the operator can easily return the posture of the earth removal plate 23 from a rocking posture for rocking the earth removal plate 23 to the predetermined normal posture simply by pressing the normalization switch 36. As a result, the work efficiency is increased.

According to the present embodiment, furthermore, when the rocking posture of the earth removal plate 23 is put back to the predetermined normal posture according to the instruction from the normalization switch 36, if the load pressure on the angle cylinder 29 is higher than the predetermined threshold value, then the controller 34 stops controlling the control valve 32, thereby increasing safety.

In the above embodiment, the operation switches 35A and 35B and the normalization switch 36 has been described as separate from each other. However, the operation switches 35A and 35B may double as a normalization switch. To put it in detail, the controller 34 may determine the content of the instruction of an instruction signal from the operation switch 35A or 35B on the basis of the length of the instruction signal. Specifically, the operation switches 35A and 35B may instruct the controller 34 to rock one side of the earth removal plate 23 and to rock the other side of the earth removal plate 23, respectively, when they are pressed shortly, and at least one of the operation switches 35A and 35B may instruct the controller 34 to return the posture of the earth removal plate 23 from the rocking posture to the predetermined normal posture when it is pressed long.

In the above embodiment, the operation unit 33 is described as including the pushbutton-type operation switches 35A and 35B. However, the present invention is not limited to such details. The operation unit 33 may be a toggle-type operation switch, for example.

In the above embodiment, furthermore, the earth removal apparatus 3 is described by way of example as including the earth removal plate 23 mounted, on the distal end portion of the stay 21 via the pin shaft 22 that extends in upward and downward directions, rockably only in forward and rearward directions, and the angle cylinder 29 for rocking the earth removal plate 23 in forward and rearward directions. However, the present invention is not limited to such details. The earth removal apparatus may include: for example, an earth removal plate mounted on a distal end portion of a stay via a universal pin (stated in detail, having a pin shaft that extends in upward and downward directions and is rotatably supported on the distal end portion of the stay, and a pin hole extending in a direction perpendicular to the pin shaft) and a rotational pin (stated in detail, extending through the pin hole in the universal pin, and supporting the earth removal plate rockably in forward and rearward directions), such that the earth removal plate is rockable in forward and rearward directions and in upward and downward directions; an angle cylinder for rocking the earth removal plate in forward and rearward directions; and a tilt cylinder for rocking the earth removal plate in upward and downward directions.

The present invention is described by way of example as applied to a hydraulic excavator having an earth removal apparatus. However, the present invention is not limited to such details. The present invention may be applied to other construction machines having an earth removal apparatus.

DESCRIPTION OF REFERENCE CHARACTERS

1: Lower track structure
2: Upper swing structure
21: Stay
23: Earth removal plate
29: Angle cylinder
31: Hydraulic pump
32: Control valve
33: Operation unit
34: Controller
35A, 35B: Operation switch
36: Normalization switch
37A, 37B: Pressure sensor

The invention claimed is:

1. A construction machine comprising: a stay mounted, on a machine body, turnably in upward and downward directions; an earth removal plate mounted, on a distal end portion of the stay, rockably in forward and rearward directions; an angle cylinder for rocking the earth removal plate in forward and rearward directions; a control valve for controlling a flow of hydraulic fluid flowing from a hydraulic pump to the angle cylinder; an operation unit for giving an instruction about rocking action of the earth removal plate in forward and rearward directions; and a controller for controlling the control valve in response to the instruction from the operation unit, wherein the construction machine includes a normalization switch for giving an instruction to the controller to set a posture of the earth removal plate to a predetermined normal posture from a rocking posture for rocking the earth removal plate in forward and rearward directions, a pressure sensor for sensing a load pressure on the angle cylinder, and a buzzer, the controller is configured to:

compute a stroke of the angle cylinder and store the computed stroke on a basis of an instruction signal from the operation unit;

control the control valve to set a stroke of the angle cylinder to a preset normal stroke in response to the instruction from the normalization switch; and stop controlling the control valve and energize the buzzer when the load pressure sensed by the pressure sensor is higher than a predetermined threshold value in controlling the control valve in response to the instruction from the normalization switch.

2. The construction machine according to claim 1, wherein the operation unit includes a pushbutton-type first operation switch for giving instruction about rocking one side of the earth removal plate when pressed shortly, and a pushbutton-type second operation switch for giving instruction about rocking another side of the earth removal plate when pressed shortly, and at least one of the first operation switch and the second operation switch doubles as the normalization switch for setting the posture of the earth removal plate, from the rocking posture, to the predetermined normal posture when pressed long.

* * * * *